United States Patent [19]

Coggins et al.

[11] Patent Number: 4,919,432

[45] Date of Patent: Apr. 24, 1990

[54] GOLF SWING GUIDE WITH BACKSWING INDICATOR

[76] Inventors: Carlos Coggins, 509 Fayetteville Ave., Bennettsville, S.C. 29512; Patrick O. McCauley, 1 Hidden Hills, Earlysville, Va. 22936

[21] Appl. No.: 201,450

[22] Filed: Jun. 2, 1988

[51] Int. Cl.[5] ..... A63B 69/36

[52] U.S. Cl. ..... 273/191 A; 273/187 R; 273/203

[58] Field of Search ..... 273/191 R, 191 A, 191 B, 273/186 R, 26 R, 26 B, 203, 187 R

[56] References Cited

U.S. PATENT DOCUMENTS 1,541,462 6/1925 Avery ..... 273/203
1,567,530 4/1924 MacNaughton et al. ..... 273/191 A
3,112,111 11/1963 Bennett ..... 273/203
3,583,707 6/1971 Fujimoto ..... 273/191

FOREIGN PATENT DOCUMENTS 8201471 5/1982 PCT Int'l Appl. ..... 273/191 A

*Primary Examiner*—Edward M. Coven
*Assistant Examiner*—Sebastiano Passaniti
*Attorney, Agent, or Firm*—Rhodes, Coats & Bennett

[57] ABSTRACT

A golf training device is disclosed comprising a circular guide which engages the shaft of the golf club to guide it through a golf swing. The circular guide includes a break point, which when encountered by the shaft of the golf club, can be sensed by the golfer through the shaft of the golf club. The break point is placed in a position to indicate to the golfer that the upper limit of a proper backswing has been reached.

6 Claims, 2 Drawing Sheets

GOLF SWING GUIDE WITH BACKSWING INDICATOR

FIELD OF THE INVENTION

The present invention relates generally to athletic training equipment and more particularly to a golf training device.

BACKGROUND OF THE INVENTION

Golf is a game in which form is emphasized over athletic ability. Proper muscle control, therefore, is essential to obtain any degree of success in playing golf. Even minute variations in the golf swing can have disastrous consequences for the golfer.

The old adage that "practice makes perfect" is no more true in any endeavor than it is in golf. The sequence of movements needed to complete an effective golf swing can be learned by repetition. For this reason, both beginning and experienced golfers flock to driving ranges where dozen of balls can be hit within a short span of time. For the experienced golfer, a few sessions a week at the driving range helps the golfer maintain his or her presumptively good form. For the inexperienced golfer, however, sessions at the driving range may serve only to engrain bad habits. Some form of assistance is needed to help the inexperienced golfer to avoid pitfalls and to develop a proper golf swing.

The theory that the golf club should move within a single plane during a proper golf swing has provided the basis for numerous golf training devices. Such devices are exemplified in U.S. Pat. Nos. 1,567,530; 2,520,287; 3,341,208; 3,583,707; and 4,583, 740. Broadly, such devices include a circular guide which engages the shaft of the golf club to direct it through a proper golf swing. The golfer uses the device by standing within the guide and swinging the golf club as if trying to strike the golf ball. The circular guide keeps the golf club in alignment during the golf swing. By repeating the golf swing, the muscles of the body can be trained to carry out the sequence of movements needed to effectuate a proper golf swing.

A drawback to such prior art devices is that there is no means to indicate to the novice golfer how far back the club should be swung, even though excessive backswing is a serious problem with novice golfers.

SUMMARY AND OBJECTS OF THE INVENTION

The present invention was developed to overcome the aforementioned problems with the prior art. This is accomplished by incorporating a break point into a circular guide which directs the golf club through a proper golf swing. The break point coincides with the upper limit of the back swing. When the golfer goes through the motions of a golf swing, the club is first drawn backward. When the club reaches the break point, this can be sensed by the golfer through the shaft of the club. This "tactile feedback" informs the golfer that the upper limits of the backswing have been reached.

Accordingly, it is an object of the present invention to provide a golf training device which allows the golfer to practice his or her golf swing.

Another object of the present invention is to provide a golf training device which guides the golf club through the golf swings to help develop a strong and effective golf swing.

Another object of the present invention is to provide a golf training device which helps exercise the muscles necessary for an effective golf swing.

Another object of the present invention is to provide a golf training device which allows the golfer to swing the club while actually hitting a golf ball.

Another object of the present invention is to provide a golf training device including means for indicating to the golfer when the upper limits of a proper backswing is reached.

Another object of the present invention is to provide a golf training device which is adjustable in height and angle to the golfer and his club.

Another object of the present invention is to provide a golf training device which is relatively simple in construction.

Other objects and advantages of the present invention will become apparent and obvious from a study of the following description and the accompanying drawings which are merely illustrative of such invention.

DETAILED DESCRIPTION OF THE INVENTION

Figure 1:
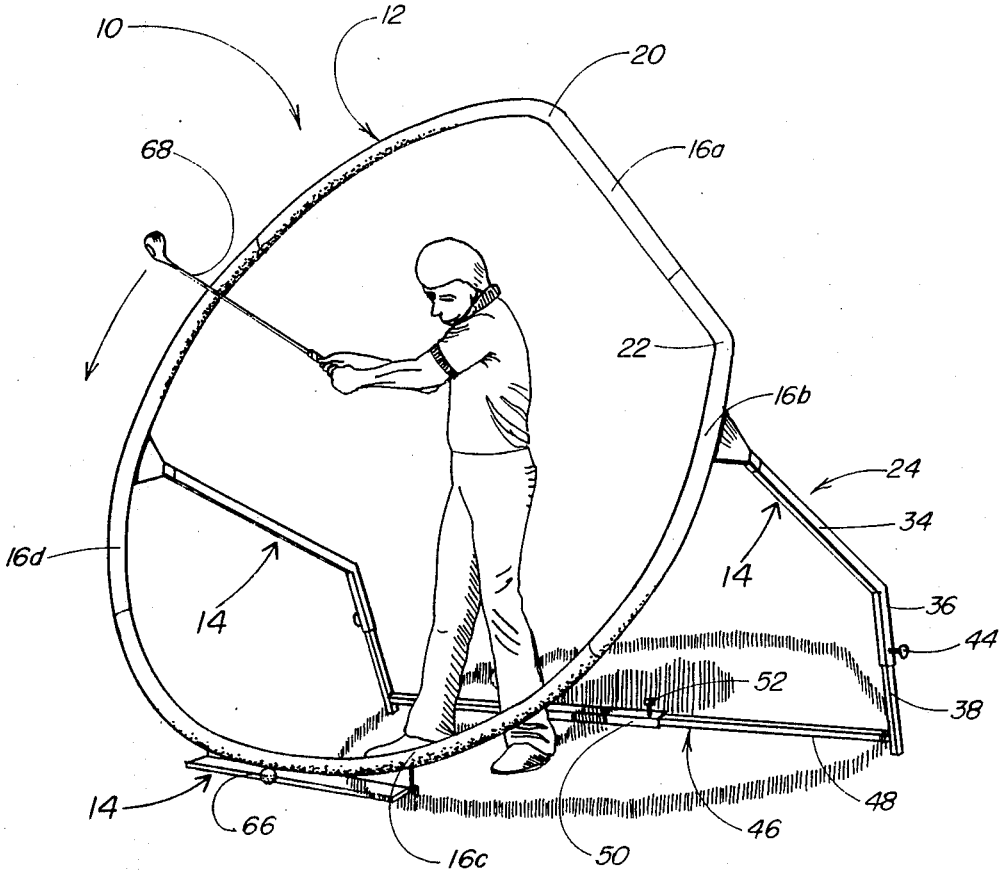
FIG. 1 is a perspective view of the golf training device of the present invention.

Referring now to the drawings, the golf training device of the present invention is shown therein and indicated generally by the numeral 10. The golf training device 10 consists of a circular guide 12 for directing the golf club during the golf swing, and a support system 14 for adjusting the height and angle of the circular guide 12.

The circular guide 12 is constructed of four circle segments **16*a* through 16*d* which are press fitted together. Each circle segment includes an integrally formed sleeve 18 bonded to the inner diameter at one end of each circle segment. To assemble the circular guide 12**, the sleeve of one circle segment is pressed into the end of an adjacent circle segment. The sleeve may be tapered slightly so that an increasingly snug fit is obtained as the segments are pressed together. No screws, bolts, or other fasteners are needed.

When fully assembled, the circular guide 12 takes the form of a truncated circle. The chord-like portion of the guide joins the circular portion of the guide at two break points 20 and 22. Break point 20 is located at a point coincident with the upper limit of a proper golf swing.

The circular guide 12 is constructed preferably of a plastic tubing such as polyvinylchloride (PVC). In the preferred embodiment, the circular guide 12 is approximately 90 inches in diameter. The PVC tubing used to construct the circular guide 12 is approximately $2\frac{1}{2}$ inches in diameter.

The support system 14 is designed to allow the height and angle of the circular guide 12 to be adjusted so that it lies within the swing plane. The swing plane is the plane through which the golf club is swung during a proper golf swing.

Figure 3:
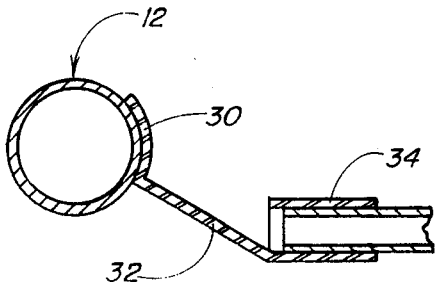
FIG. 3 is a section view thereof illustrating the side support assembly.
Figure 4:
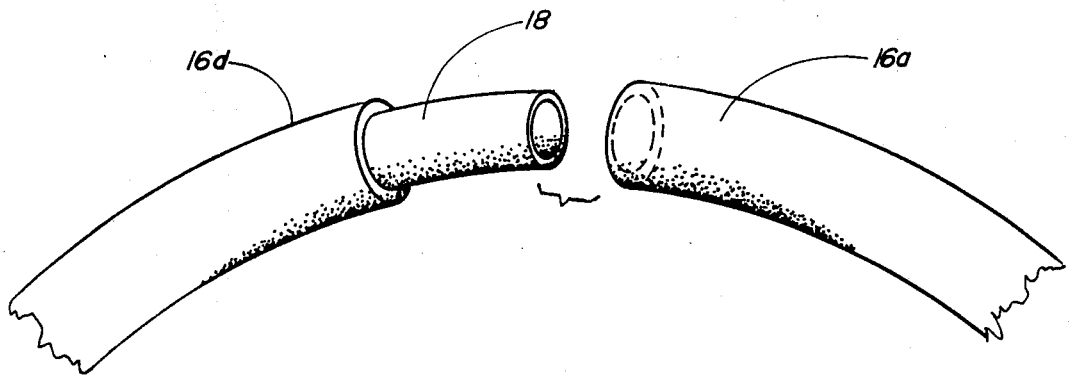
FIG. 4 is a detailed perspective view showing two adjacent circle segments which are separated.

In a preferred embodiment, the circular guide 12 includes two side support assemblies 24 and a center support assembly 26 which support the circular guide 12 at three points. The side support assemblies 24 include two diametrically opposed brackets 28 secured to the circular guide 12. Brackets 28, shown in FIG. 3, include an arcuate flange 30 secured to the edge of a main body 32. The arcuate flange 30 slats against the back of the circular guide 12 to which it is bolted or otherwise fixedly secured. The main body 32 of the bracket extends rearwardly and outwardly from the circular guide 12.

An upper support member 34 is secured at one end to the main body 32 by weldment or other suitable means. At the opposite end, the support member 34 includes a down-turned portion 36. The down-turned portion 36 telescopically receives the upper end of a lower support member 38. A set screw 44 is threaded into an opening formed in the downturned portion 36, until the end of the screw 44 engages the upper end of the lower support member 38. The position of the upper and lower support members 34 and 38 can, thus, be adjusted by loosening the set screw, moving the upper and lower support members with respect to each other to the desired position, and then retighting the set screw 44.

In a preferred embodiment of the invention, the lower support members 38 are connected by a crossbar assembly 46 which gives the side support assemblies 24 some lateral stability. A pair of lateral tubes 48 and 58 extends inwardly from the lower end of each lower support member 38. Lateral tube 48 is telescopically received in lateral tube 50. A setscrew 52 extends through threaded openings at one opposite end of the lateral tube 50 to secure the lateral tubes with respect to each other. Thus, the spacing between the side support assemblies 24 can be adjusted to accommodate circular guides 12 of varying diameter.

Figure 2:
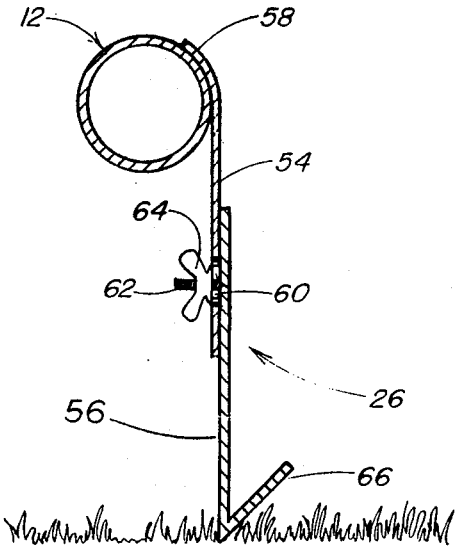
FIG. 2 is a section view thereof illustrating the center support assembly.

The center support assembly 26, shown in FIG. 2, includes a pair of support plates 54 and 56. The upper support plate 54 includes an arcuate edge 58 which is secured to the circular guide 12. The upper support plate 54 also includes a pair of guide slots 60.

The lower support plate 56 includes two studs 62 secured along the upper edge thereof which extends through the guide slot 60 in the upper support plate 54. Wing nuts 64, threaded onto the stud 62, can be tightened against the upper support plate 54 to secure the upper and lower support plates together.

An upturned flange 66 extends along the lower edge of the lower support plate 56. The upturned flange 66 reinforces the lower ground engaging edge of the support plate 56.

Figure 5:
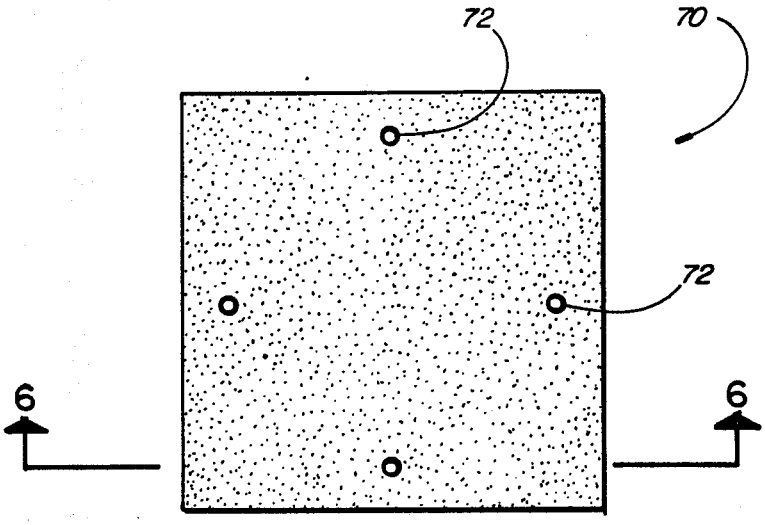
FIG. 5 is a top plan view of a golf mat used in conjunction with the circular guide.
Figure 6:
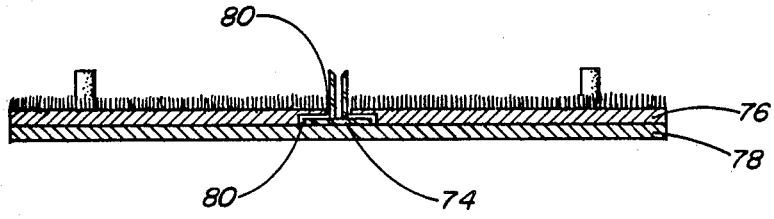
FIG. 6 is a section view taken through line 6-6 of FIG. 5.

In FIGS. 5 and 6, there is illustrated a golf mat indicated generally at 70 which can be used in connection with the present invention. The golf mat 70 includes four golf tees 72 of different height to simulate various conditions encountered on the golf course. The tees 72 include a generally square base portion 79 which is between two laminates 76 and 78. The upper laminate 76 is an artificial grass mat and includes a plurality of openings 80 through which the tees 72 extend. The base portion 74 of the tees 72 are disposed within recessed areas 82 surrounding openings 80. The lower laminate is made of neoprene or other resilient material and is secured to the upper laminate by a suitable adhesive.

To use the golf training device 10 of the present invention, the circular guide 12 is first assemblied by pressing the individual circle segments together as hereinabove described. It is important to assure that each connection is aligned properly and seated completely. The support system 14 is also assembled by inserting the lower support member 38 into the down-turned portion of the upper support member 34. The set screw 44 is then tightened against the lower support member 38 to secure the same. The lateral tube 50 is then slid over the end of the lateral tube 48 and secured in the appropriate position by tightening the set screws 52.

Once the device is assemblied, the height and angle of the circular guide 12 can be adjusted so that it lies within the swing plane. The height of the circular guide 12 is adjusted by loosening the wing nuts 64 securing the upper and lower support plates 54 and 56. Once loosened, the studs 62 can slide within the respective guide slots 60 to raise or lower the circular guide 12. When the appropriate height has been obtained, the wing nuts 64 are retightened.

The angle of the circular guide 12 is adjusted by either lengthening or shortening the side support assemblies 24. This is done by loosening the set screw 44 which secures the upper and lower support members 34 and 38. To increase the angle of the swing plane (make it more vertical), the lower support member 38 is extended. Conversely, the angle of the swing plane is decreased by retracting the lower support member 38 into the down-turned portion 36.

Once the training device 10 is assembled and proper adjustments are made, the golfer stands within the circle and places the shaft of his or her golf club against the circular guide 12. The golf mat 70 is placed adjacent to the lowermost portion of the circular guide 12 with the desired tee 72 being closest. A golf ball 66 is then placed on tee 72 adjacent the lowermost portion of the circular guide 12.

The golf swing begins with the head of the club 68 directly behind the golf ball. The club is drawn backward while maintaining the shaft in contact with the circular guide 12 as shown in FIG. 1. When the shaft of the golf club reaches the break point **12*a*, the golfer will be able to sense the encounter with the break point through the shaft of the golf club. This "tactile feedback" informs the golfer that the upper limits of the back swing have been reached. The golfer then swings the club forwardly, again maintaining the shaft of the club in contact with the circular guide. The circular guide 12** will direct the club through the swing and maintain it in proper alignment through the entire swing.

The present invention enables the golfer to exercise and strengthen muscles necessary to an effective golf swing. In addition, the device provides some positive feedback which enables the novice golfer to determine when he has reached the upper limits of a proper golf swing.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A golf swing training device to assist in the development of a proper golf swing comprising: a golf club guide in the form of a closed loop for engaging the shaft of a golf club and guiding the golf club during the golf swing, said golf club guide including backswing indicator means coincident with the upper limit of a proper backswing so that when the indicator means is encountered by the shaft of the golf club it can be sensed by the user through the shaft of the club, said indicator means being nonrestrictive so as to enable the golf club to be swung beyond the indicator means.

2. The golf swing training device according to claim 1 wherein said golf club guide lies substantially in a plane, said guide having first adjustment means for adjusting the height of the golf club guide and a second adjustment means for adjusting the inclination of the golf club guide.

3. The golf swing training device according to claim 2 wherein said first adjustment means comprises a first leg means of adjustable length attached to the lowermost portion of the golf club guide.

4. The golf swing training device according to claim 2 wherein the second adjustment means comprises a pair of legs of independently adjustable length attached to diametrically opposed points of said golf club guide.

5. The golf swing training device according to claim 1 further including a golf mat having a plurality of differently sized golf tees which can be selectively disposed adjacent the lowermost portion of the golf club guide.

6. The golf swing training device according to claim 1 wherein the golf club guide is in the form of a truncated circle including a first portion extending substantially through the arc of a circle from a first breakpoint to a second breakpoint, and a second portion extending chordwise between said breakpoints, and wherein said indicating means comprises one of said breakpoints positioned coincident with the upper limit of a proper backswing so that when the breakpoint is encountered by the shaft of the golf club it can be sensed by the user.

* * * * *